US006291396B1

(12) United States Patent
Bodem et al.

(10) Patent No.: US 6,291,396 B1
(45) Date of Patent: Sep. 18, 2001

(54) PLASTICIZED CROSS-LINKED RECEIVING ELEMENT FOR THERMAL DYE TRANSFER

(75) Inventors: George B. Bodem, Pittsford; Brian T. Pope, Penfield, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/465,206

(22) Filed: Dec. 15, 1999

(51) Int. Cl.[7] ..... B41M 5/035; B41M 5/38

(52) U.S. Cl. ..... 503/227; 428/195; 428/412; 428/423.1; 428/480; 428/913; 428/914

(58) Field of Search ..... 8/471; 428/195, 428/412, 423.1, 480, 913, 914; 503/227

(56) References Cited

U.S. PATENT DOCUMENTS

| | | | |
|---|---|---|---|
| 4,621,271 | 11/1986 | Brownwtein | 346/76 PH |
| 4,871,715 | 10/1989 | Harrison et al. | 503/227 |
| 5,266,551 | 11/1993 | Bailey et al. | 503/227 |
| 5,296,446 | 3/1994 | Fujimura et al. | 503/227 |
| 5,411,931 | 5/1995 | Kung | 503/227 |
| 6,096,685 * | 8/2000 | Pope et al. | 503/227 |

FOREIGN PATENT DOCUMENTS 199 57 344 A1 6/2000 (DE) .

WO 97 12283 A 4/1997 (WO) .

* cited by examiner

*Primary Examiner*—Bruce H. Hess
(74) *Attorney, Agent, or Firm*—Harold E. Cole

(57) ABSTRACT

A dye-receiving element for thermal dye transfer comprising a support having on one side thereof a dye image-receiving layer comprising a polymeric binder and an aliphatic ester plasticizer, the polymeric binder comprising a crosslinked polymer network being formed by the reaction of a multi-functional isocyanate with:

a) a polycarbonate polyol having at least two terminal hydroxy groups and an average molecular weight of about 1000 to about 10,000, and b) an aliphatic glycol having at least one of the following formulas:

$$HO—(CH_2)_n—OH$$

$$HO—[(CH_2)_n—O]_m—H$$

or $$HO—[(CH_2)_5—CO_2]_p—[(CH_2)_n—O]_m—H$$

where
n is between about 3 and about 10,
m is between about 3 and about 60, and
p is between about 1 and about 16.

14 Claims, No Drawings

PLASTICIZED CROSS-LINKED RECEIVING ELEMENT FOR THERMAL DYE TRANSFER

CROSS REFERENCE TO RELATED APPLICATION

Reference is made to commonly-assigned copending U.S. patent application Ser. No. 09/203,858, filed Dec. 2, 1998 entitled Cross-Linked Receiving Element for Thermal Dye Transfer by Pope et al., the teachings of which are incorporated herein by reference.

FIELD OF THE INVENTION

This invention relates to dye-receiving elements used in thermal dye transfer, and more particularly to a polymeric dye image-receiving layer for such elements.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye donor elements used in thermal dye transfer generally include a support bearing a dye layer comprising heat transferable dye and a polymeric binder. Dye receiving elements generally include a support bearing on one side thereof a dye image-receiving layer. The dye image-receiving layer conventionally comprises a polymeric material chosen from a wide assortment of compositions for its compatibility and receptivity for the dyes to be transferred from the dye donor element. The polymeric material must also provide adequate light stability for the transferred dye images. Many of the polymers which provide these desired properties, however, often lack the desired strength and integrity to stand up to the rigors of thermal printing. For example, a significant problem which can be encountered during thermal printing is sticking of the dye donor to the receiver. Gloss and abrasion resistance may also be marginal with many receiving layer polymers.

Increasing the hardness of the receiver layer with polymers having higher glass transition temperatures (Tg) can improve physical properties, but penetration of the dye into such layers may be impaired.

An alternate approach to achieve improved film properties is to crosslink the polymer. Crosslinking may be achieved in a variety of different ways, including reaction curing, catalyst curing, heat curing, and radiation curing. In general, a crosslinked polymer receiver layer may be obtained by crosslinking and curing a polymer having a crosslinkable reaction group with an additive having a crosslinkable reaction group, as is discussed in EPO 394 460, the disclosure of which is incorporated by reference. This reference, e.g., discloses receiving layers comprising polyester polyols crosslinked with multifunctional isocyanates. While such crosslinked polyester receiving layers are generally superior in resistance to sticking compared to non-crosslinked polyesters, light stability for transferred image dyes may still be a problem.

U.S. Pat. No. 5,266,551 relates to a dye-image receiving layer for thermal dye transfer wherein the receiving layer comprises a crosslinked polymer network formed by the reaction of multifunctional isocyanates with polycarbonate polyols having two terminal hydroxy groups. However, there is a problem with this dye image-receiving layer in that images transferred to it have low density.

U.S. Pat. No. 4,871,715 relates to dye image-receiving elements containing phthalate esters in the receiving layer. However, there is a problem with these plasticizers in that the light fade of the transferred image is not as good as one would like.

It is an object of this invention to provide a dye image-receiving element for thermal dye transfer processes having improved dye uptake and image stability. It is a further object of the invention to be able to coat such a receiving layer with a minimum amount of chlorinated solvent.

SUMMARY OF THE INVENTION

These and other objects are achieved in accordance with the invention comprising a dye-receiving element for thermal dye transfer comprising a support having on one side thereof a dye image-receiving layer comprising a polymeric binder and an aliphatic ester plasticizer, the polymeric binder comprising a crosslinked polymer network being formed by the reaction of a multifunctional isocyanate with:

a) a polycarbonate polyol having at least two terminal hydroxy groups and an average molecular weight of about 1000 to about 10,000, and b) an aliphatic glycol having at least one of the following formulas:

$$HO—(CH_2)_n—OH$$

$$HO—[(CH_2)_n—O]_{m—H}$$

or $$HO—[(CH_2)_5—CO_2]_{p—[(CH2)_n—O]_m—H}$$

where n is between about 3 and about 10, m is between about 3 and about 60, and p is between about 1 and about 16.

An improvement in density is achieved by this receiving element, while the superior properties, such as image stability and fingerprint resistance, of the resulting image-receiving layer are fully maintained.

DESCRIPTION OF THE PREFERRED EMBODIMENTS

The crosslinked polymers of the invention may be made by using the polycarbonate polyol polymer of U.S. Pat. No. 5,266,551 and adding to it the aliphatic glycol described above. The aliphatic glycol and the polycarbonate polyol then react with the multifunctional isocyanate during drying to form a three-dimensional crosslinked network.

In a preferred embodiment of the invention, the crosslinked polymer network has the formula:

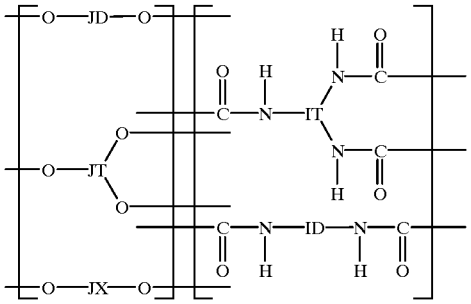

wherein:

JD and JT together represent from 50 to 100 mol % polycarbonate segments derived from a polycarbonate polyol having an average molecular weight of from about 1000 to about 10,000 and from 0 to 50 mol % segments derived from a polyol having a molecular weight of less than about 1000;

JX represents aliphatic glycol segments derived from said aliphatic glycol having an average molecular weight from about 100 to about 11,000; and ID and IT each independently represent aliphatic, cycloaliphatic, arylaliphatic, or aromatic radicals of multifunctional isocyanate units.

In a preferred embodiment of the invention, the polycarbonate polyol comprises bisphenol A derived units and diethylene glycol derived units. In another preferred embodiment, the terminal hydroxy groups of the polycarbonate polyol comprises aliphatic hydroxyl groups. In still another preferred embodiment, the terminal hydroxy groups of the polycarbonate polyols comprise phenolic groups. In yet still another preferred embodiment, the terminal hydroxy groups of the polycarbonate polyol comprises a mixture of phenolic groups and aliphatic hydroxyl groups. In still another preferred embodiment, at least 50 mol % of said multifunctional isocyanate is at least trifunctional. In another preferred embodiment, the polyol and multifunctional isocyanate are reacted to form the crosslinked polymer network in amounts such that the equivalent of polyol hydroxyl groups is from 60 to 140% of the equivalent of isocyanate groups. In yet still another preferred embodiment, the glycol has the formula:

$$HO—[(CH_2)_n—O]_m—H$$

where n is 4, and m is between about 8 and about 40.

As noted above, an aliphatic ester plasticizer is employed in the dye image-receiving layer. Suitable aliphatic ester plasticizers include both monomeric esters and polymeric esters. Examples of aliphatic monomeric esters include ditridecyl phthalate, dicyclohexyl phthalate and dioctylsebacate. Examples of aliphatic polyesters include polycaprolactone, poly(1,4-butylene adipate) and poly (hexamethylene sebacate).

In a preferred embodiment of the invention, the monomeric ester is dioctylsebacate or bis-(1-octyloxy-2,2,6,6-tetramethyl-4-piperidinyl), Tinuvin 123® (Ciba Geigy Co.). In another preferred embodiment, the aliphatic polyester is poly(1,4-butylene adipate) or the 1,3-butane diol polymer with hexanedioc acid, 2-ethylhexyl ester, sold commercially as Admex 429® (Velsicol Chemical Corp.) or poly (hexamethylene sebacate).

The plasticizer may be present in the dye image-receiving layer in any amount which is effective for the intended purpose. In general, good results have been obtained when the plasticizer is present in an amount of from about 5 to about 100%, preferably from about 10 to about 20%, based on the weight of the polymeric binder in the dye image-receiving layer.

The support for the dye-receiving element of the invention may be a polymeric, a synthetic paper, a cellulosic paper support, transparent supports such as poly(ethylene terephthalate) or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, barium sulfate, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150; 4,965,238; 4,965,239 and 4,965,241, the disclosures of which are incorporated by reference. The receiver element may also include a backing layer such as those disclosed in U.S. Pat. Nos. 5,011,814; 5,891,827 and 5,096,875, the disclosures of which are incorporated by reference.

The invention plasticizers may be used in a receiving layer alone or as mixtures. In addition to the polymeric binder described above, the receiving layer may also contain other polymer such as polycarbonates, polyurethanes, polyesters, polyvinyl chlorides, poly(styrene-co-acrylonitrile), poly(caprolactone), etc.

The dye image-receiving layer may be present in any amount which is effective for its intended purpose. In general, good results have been obtained at a receiver layer concentration of from about 0.1 to about 1.0 g/m$^2$.

The receiving layer of the invention may also contain a release agent, such as a silicone or fluorine based compound, as is conventional in the art.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803 and 5,023,228, the disclosures of which are incorporated by reference. Specific examples of such dyes include the following:

Magenta Dye M-1

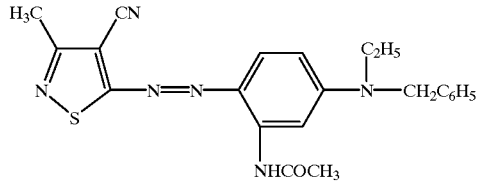

-continued

Magenta Dye M-2

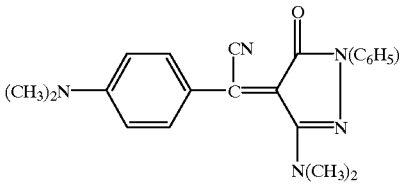

Magenta Dye M-3

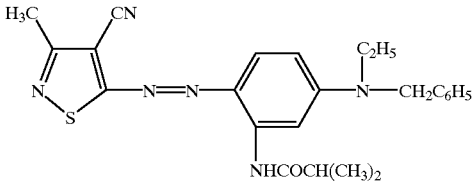

Yellow Dye Y-1

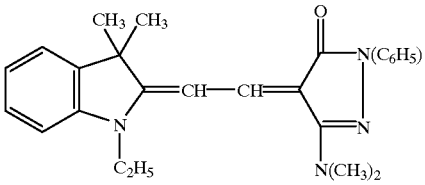

Yellow Dye Y-2

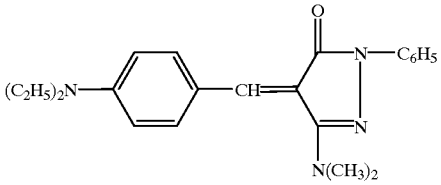

Cyan Dye C-1

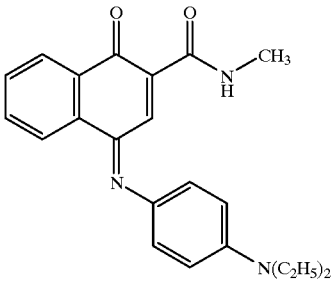

Cyan Dye C-2

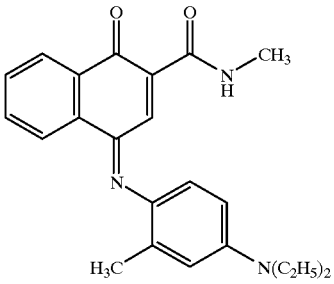

-continued

Cyan Dye C-3

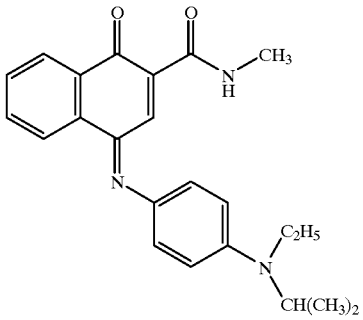

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained. The dye-donor element may also contain a colorless area which is transferred to the receiving element to provide a protective overcoat. This protective overcoat is transferred to the receiving element by heating uniformly at an energy level equivalent to about 85% of that required to print maximum image dye density.

Thermal printing heads which can be used to transfer dye from dye-donor elements to the receiving elements of the invention are available commercially. There can be employed, for example, a Fujitsu Thermal Head (FTP040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention;

EXAMPLES

Example 1

Control Receiver C-1 (no plasticizer)

This element was prepared by first extrusion-laminating a paper core with a 38 $\mu$m thick microvoided composite film (OPPalyte® 350TW, Mobil Chemical Co.) as disclosed in U.S. Pat. No. 5,244,861. The composite film side of the resulting laminate was then coated with a dye-receiving layer of C1 polycarbonate polyol (2.36 g/m$^2$) as disclosed in U.S. Pat. No. 5,266,551; Desmondur® N3300 hexamethylene diisocyanate resin (Bayer Corp.) (0.147 g/m$^2$); Desmondur® Z-4370/2 isophorone diisocyanate resin (Bayer Corp.) (0.590 g/m$^2$); Terathane® 1000 (DuPont Co.) (mw 1000) (0.228 g/m$^2$), dibutyltin diacetate catalyst (Air Products Co.) (0.008 g/m$^2$); Fluorad FC-431® surfactant (3M Corporation) (0.017 g/m$^2$), and DC 510 surfactant (Dow Corning Corp.) (0.008 g/m$^2$).

Control Receiver C-2 (U.S. patent application Ser. No. 09/203,858)

This element is the same as C-1 except that it also contained a plasticizer, diphenyl phthalate (0.422 g/m$^2$).

Element E-1 of the Invention

This element was prepared similar to C-1 except that it contained ditridecyl phthalate (0.48 g/m$^2$).

Element E-2 of the Invention

This element was prepared similar to C-1 except that it contained polycaprolactone (0.48 g/m$^2$).

Element E-3 of the Invention

This element was prepared similar to C-1 except that it contained dioctyl sebacate (0.48 g/m$^2$).

Element E-4 of the Invention

This element was prepared similar to C-1 except that it contained bis-(1-octyloxy-2,2,6,6-tetramethyl-4-piperidinyl) sebacate (Tinuvin® 123) (0.48 g/m$^2$).

Element E-5 of the Invention

This element was prepared similar to C-1 except that it contained bis-(1-octyloxy-2,2,6,6-tetramethyl-4-piperidinyl) sebacate (Tinuvin® 123) (0.24 g/m$^2$) and dioctyl sebacate (0.24 g/m$^2$).

Element E-6 of the Invention

This element was prepared similar to C-1 except that it contained bis-(1-octyloxy-2,2,6,6-tetramethyl-4-piperidinyl) sebacate (Tinuvin ® 123) (0.24 g/m$^2$) and a polyester sebacate sold commercially as Paraplex G-25® (C.P. Hall Co.) (0.24 g/m$^2$).

Element E-7 of the Invention

This element was prepared similar to C-1 except that it contained bis-(1-octyloxy-2,2,6,6-tetramethyl-4-piperidinyl) sebacate (Tinuvin® 123) (0.24 g/m$^2$) and 1,3-butane diol polymer with hexanedioc acid, 2-ethylhexyl ester, sold commercially as Admex 429® (0.24 g/m$^2$).

Dye-Donor Element

A 4-patch protective layer dye-donor element was prepared by coating on a 6 $\mu$m poly(ethylene terephthalate) support:

1) a subbing layer of titanium alkoxide (DuPont Tyzor TBT)® (0.12 g/m2) from a n-propyl acetate and n-butyl alcohol solvent mixture, and
2) a slipping layer containing an aminopropyldimethyl-terminated polydimethylsiloxane, PS513® (United Chemical Technologies, Inc.)(0.01 g/m2), a poly(vinyl acetal) binder, KS-1 (Sekisui Co.) (0.38 g/m2), p-toluenesulfonic acid (0.0003 g/m$^2$), polymethylsilsesquioxane beads 0.5 $\mu$m (0.06 g/m$^2$) and candellila wax (0.02 g/m$^2$) coated from a solvent mixture of diethyl ketone and methanol.

On the opposite side of the support was coated:

1) a patch-coated subbing layer of titanium alkoxide (TyzorTBT)® (0.13 g/m$^2$) from a n-propyl acetate and n-butyl alcohol solvent mixture, and
2) repeating yellow, magenta and cyan dye patches containing the compositions as noted below over the subbing layer and a protective patch on the unsubbed portion as identified below.

The yellow composition contained 0.07 g/m$^2$ of the first yellow dye illustrated above, 0.09 g/m$^2$ of the second yellow dye illustrated above, 0.25 g/m$^2$ of CAP48220 (20 s viscosity) cellulose acetate propionate, 0.005 g/m$^2$ of Paraplex G-25® plasticizer and 0.004 g/m$^2$ divinylbenzene beads (2 $\mu$m beads) in a solvent mixture of toluene, methanol and cyclopentanone (66.5/28.5/5).

The magenta composition contained 0.07 g/m$^2$ of the first magenta dye illustrated above, 0.14 g/m$^2$ of the second magenta dye illustrated above, 0.06 g/m$^2$ of the third magenta dye illustrated above, 0.28 g/m$^2$ of CAP482-20 (20 s viscosity) cellulose acetate propionate, 0.06 g/m$^2$ of Paraplex G-25® plasticizer, 0.05 g/m$^2$ of monomeric glass illustrated below, and 0.005 g/m$^2$ divinylbenzene beads (2 $\mu$m beads) in a solvent mixture of toluene, methanol and cyclopentanone (66.5/28.5/5).

The cyan composition contained 0.10 g/m$^2$ of the first cyan dye illustrated above, 0.09 g/m2 of the second cyan dye illustrated above, 0.22 g/m$^2$ of the third cyan dye illustrated above, 0.23 g/m$^2$ of CAP482-20 (20 s viscosity) cellulose acetate propionate, 0.02 g/m$^2$ of Paraplex G-25®) plasticizer, 0.04 g/m$^2$ of monomeric glass illustrated below, and 0.009 g/m$^2$ divinylbenzene beads (2 $\mu$m beads) in a solvent mixture of toluene, methanol and cyclopentanone (66.5/28.5/5).

The protective patch contained a mixture of poly(vinyl acetal) (0.53 g/m$^2$) (Sekisui KS-10), colloidal silica IPA-ST (Nissan Chemical Co.) (0.39 g/m$^2$) and 0.09 g/m$^2$ of divinylbenzene beads (4 $\mu$m beads) which was coated from a solvent mixture of diethylketone and isopropyl alcohol (80:20).

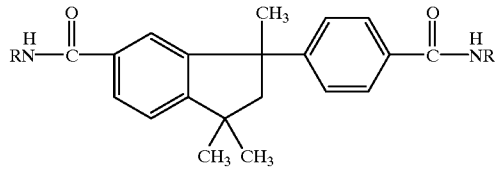

Monomeric Glass wherein R is

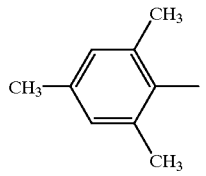

Test conditions

A neutral step image was obtained consisting of 11 patches from about 0 to about 2.5 density units. This image was read with an X-Rite® (model 820 densitometer. D-Max green density is reported in table below. The image was then subjected to a 14 day fading test by a 6500 watt, Xenon light source with inner and outer borosilicate filters. The source to sample distance was adjusted to give a 50 Klux photometric intensity. The percent loss in color density in the faded samples from about 1.0 initial density in the unfaded samples is reported in the following table:

TABLE 1

| Element | D-Max | % Neutral Fade | | |
|---|---|---|---|---|
| | | Red | Green | Blue |
| Control 1 | 2.09 | 30 | 15 | 12 |
| Control 2 | 2.36 | 79 | 46 | 50 |
| 1 | 2.35 | 42 | 21 | 19 |
| 2 | 2.29 | 41 | 21 | 19 |
| 3 | 2.23 | 34 | 18 | 15 |
| 4 | 2.26 | 29 | 16 | 14 |
| 5 | 2.39 | 27 | 14 | 10 |
| 6 | 2.60 | 28 | 12 | 8 |
| 7 | 2.57 | 32 | 14 | 8 |

The above results show that use of the plasticizers according to the invention greatly reduced the dye fade as compared to the control with a diphenyl phthalate plasticizer. While the images in C-1 with no plasticizer had good light fade properties, it had poorer D-max than the other elements with a plasticizer. Only the elements of the invention had both good D-max and good light fade properties.

Although the invention has been described in detail with reference to certain preferred embodiments for the purpose of illustration, it is to be understood that variations and modifications can be made by those skilled in the art without departing from the spirit and scope of the invention.

What is claimed is:

1. A dye-receiving element for thermal dye transfer comprising a support having on one side thereof a dye image-receiving layer comprising a polymeric binder and an aliphatic ester plasticizer, said polymeric binder comprising a crosslinked polymer network being formed by the reaction of a multifunctional isocyanate with:

a) a polycarbonate polyol having at least two terminal hydroxy groups and an average molecular weight of about 1000 to about 10,000, and b) an aliphatic glycol having at least one of the following formulas:

$$HO—(CH_2)_n—OH$$

$$HO—[(CH_2)_n—O]_m—H$$

or $$HO—[(CH_2)_5—CO_2]_p—[(CH_2)_n—O]_m—H$$

where n is between about 3 and about 10, m is between about 3 and about 60, and p is between about 1 and about 16.

2. The element of claim 1 wherein said aliphatic ester plasticizer is a polyester or a monomeric ester.

3. The element of claim 2 wherein said polyester is poly(1,4-butylene adipate), polycaprolactone or poly (hexamethylene sebacate).

4. The element of claim 2 wherein said monomeric ester is dioctyl sebacate, ditridecyl phthalate or bis-(1-octyloxy-2,2,6,6-tetramethyl-4-piperidinyl) sebacate.

5. The element of claim 1 wherein said crosslinked polymer network has the formula:

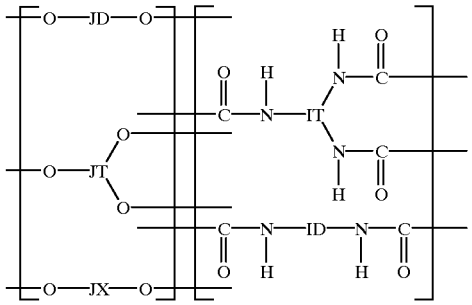

wherein:

JD and JT together represent from 50 to 100 mol % polycarbonate segments derived from a polycarbonate polyol having an average molecular weight of from about 1000 to about 10,000 and from 0 to 50 mol % segments derived from a polyol having a molecular weight of less than about 1000;

JX represents aliphatic glycol segments derived from said aliphatic glycol having an average molecular weight from about 100 to about 11,000; and ID and IT each independently represent aliphatic, cycloaliphatic, arylaliphatic, or aromatic radicals of multifunctional isocyanate units.

6. The element of claim 1 wherein said polycarbonate polyol comprises bisphenol A derived units and diethylene glycol derived units.

7. The element of claim 1 wherein said terminal hydroxy groups of said polycarbonate polyol comprises aliphatic hydroxyl groups.

8. The element of claim 1 wherein said terminal hydroxy groups of said polycarbonate polyols comprise phenolic groups.

9. The element of claim 1 wherein said terminal hydroxy groups of said polycarbonate polyol comprises a mixture of phenolic groups and aliphatic hydroxyl groups.

10. The element of claim 1 wherein at least 50 mol % of said multifunctional isocyanate is at least trifunctional.

11. The element of claim 1 wherein said polyol and multifunctional isocyanate are reacted to form said crosslinked polymer network in amounts such that the equivalent of polyol hydroxyl groups is from 60 to 140% of the equivalent of isocyanate groups.

12. The element of claim 1 wherein said glycol has the formula:

$$HO—[(CH_2)_n—O]_m—H$$

where n is 4, and m is between about 8 and about 40.

13. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, wherein said dye image-receiving layer comprises a crosslinked polymer network being formed by the reaction of a multifunctional isocyanate with:

a) a polycarbonate polyol having at least two terminal hydroxy groups and an average molecular weight of about 1000 to about 10,000, and b) an aliphatic glycol having at least one of the following formulas:

$$HO—(CH_2)_n—OH$$

$$HO—[(CH_2)_n—O]_m—H$$

or $$HO—[(CH_2)_5—CO_2]_p—[(CH_2)_n—O]_m—H$$

where
n is between about 3 and about 10,
m is between about 3 and about 60, and
p is between about 1 and about 16.

14. A thermal dye transfer assemblage comprising: (a) a dye-donor element comprising a support having thereon a dye layer and (b) a dye-receiving element comprising a support having thereon a dye image-receiving layer, said dye-receiving element being in a superposed relationship with said dye-donor element so that said dye layer is in contact with said dye image-receiving layer; wherein said dye image-receiving layer comprises a crosslinked polymer network being formed by the reaction of a multifunctional isocyanate with:

a) a polycarbonate polyol having at least two terminal hydroxy groups and an average molecular weight of about 1000 to about 10,000, and b) an aliphatic glycol having at least one of the following formulas:

$$HO—(CH_2)_n—OH$$

$$HO—[(CH_2)_n—O]_m—H$$

or $$HO—[(CH_2)_5—CO_2]_p—[(CH_2)_n—O]_m—H$$

where
n is between about 3 and about 10,
m is between about 3 and about 60, and
p is between about 1 and about 16.

* * * * *